US006152318A

United States Patent [19]

Walker

[11] Patent Number: 6,152,318

[45] Date of Patent: Nov. 28, 2000

[54] STORAGE CONTAINER WITH SELF-RETAINING LID

[76] Inventor: Jack A. Walker, N38 W27273 Parkside Rd., Pewaukee, Wis. 53072

[21] Appl. No.: 09/238,230

[22] Filed: Jan. 27, 1999

Related U.S. Application Data

[63] Continuation-in-part of application No. 08/803,272, Feb. 20, 1997, Pat. No. 5,868,268.

[51] Int. Cl.[7] ..... B65D 43/03

[52] U.S. Cl. ..... 220/379; 215/305; 215/307; 215/309; 215/395; 220/212; 220/324; 220/366.1; 220/367.1; 220/789; 220/791; 206/508

[58] Field of Search ..... 206/508, 509, 206/511, 512; 215/319, 396, 393, 395, 376, 307, 309, 329, 305; 220/212, 288, 324, 366.1, 367.1, 374, 789, 791, 793, 379, 630, 287, 629, 631, 796, 799–802, 4.03

[56] References Cited

U.S. PATENT DOCUMENTS

| | | | |
|---|---|---|---|
| 862,953 | 8/1907 | Westlake | 215/376 |
| 893,469 | 7/1908 | Essmuller | 215/319 |
| 1,335,645 | 3/1920 | Benson | 220/212 |
| 1,755,944 | 4/1930 | Adams | 215/376 |
| 2,054,094 | 9/1936 | Murch | 220/799 X |
| 2,057,972 | 10/1936 | Pieck | 215/393 X |
| 2,144,273 | 1/1939 | Raymond | 229/125.19 X |
| 2,766,796 | 10/1956 | Tupper | 220/212 X |
| 2,908,473 | 10/1959 | Snyder | 215/376 X |
| 2,955,722 | 10/1960 | Antonious | 215/393 |
| 3,079,037 | 2/1963 | Schechter | 215/393 X |
| 3,107,028 | 10/1963 | De Roberts | 220/212 |
| 3,157,304 | 11/1964 | Judge | 215/319 |
| 3,246,786 | 4/1966 | Holley | 220/212 X |
| 3,317,069 | 5/1967 | Chin | 215/393 X |
| 3,317,097 | 5/1967 | Giordano | 220/324 X |
| 3,350,131 | 10/1967 | Tanzer | 215/393 X |
| 3,516,572 | 6/1970 | Davis | 220/784 X |
| 3,606,074 | 9/1971 | Hayes | 215/393 X |
| 3,945,491 | 3/1976 | Lindenbaum | 215/376 X |
| 4,144,968 | 3/1979 | Shelton . | |
| 4,270,668 | 6/1981 | Berfield | 220/324 |
| 4,355,111 | 10/1982 | Shimizu et al. | 215/307 X |
| 4,583,668 | 4/1986 | Maynard et al. | 215/319 X |
| 4,749,102 | 6/1988 | Oldham | 220/324 |

(List continued on next page.)

FOREIGN PATENT DOCUMENTS

| | | | |
|---|---|---|---|
| 430453 | 6/1926 | Germany | 220/202 |
| 332758 | 9/1958 | Switzerland | 215/319 |

*Primary Examiner*—Stephen K. Cronin
*Assistant Examiner*—Robin A. Hylton
*Attorney, Agent, or Firm*—Donald J. Ersler

[57] ABSTRACT

A storage container with self-retaining lid includes a lid and a storage container. The structure for attaching the lid can be molded on to the bottom of the storage container, molded to the top of the lid, or molded to the lid and the bottom of the storage container. There are several preferred embodiments of the self-retaining lid. In a first preferred embodiment, the lid has a rim with a recessed cavity for firmly receiving a lip of the storage container. In a second preferred embodiment, a bottom of the storage container has a lip which is sized to be firmly inserted into a sealing cavity of the lid. In a third preferred embodiment, a bottom of the storage container has a plurality of balls which are disposed to mate with a plurality of sockets on the lid. In a fourth preferred embodiment, a plurality of hooks are molded into at least two sides of the container and sized to receive the peripheral edge of the lid. In a fifth preferred embodiment, the bottom of the storage container has a plurality of corner lips which are sized to be firmly inserted into the sealing cavity of the lid. In a sixth preferred embodiment, the lid has a plurality of blocks with recessed cavities for firmly receiving a lip of the storage container. A lid of a styrofoam cup may be attached to the bottom thereof by molding a recessed cavity in the lid. A lid of a glass jar may be attached to the bottom thereof by molding a lip with thread projections in the bottom of the jar. A lid and storage container include a sealing structure that allows moisture to escape in a first position and seal in a second position.

6 Claims, 6 Drawing Sheets

U.S. PATENT DOCUMENTS

| | | | |
|---|---|---|---|
| 5,040,834 | 8/1991 | Kahl et al. | 220/324 X |
| 5,085,337 | 2/1992 | Kos | 220/324 |
| 5,125,697 | 6/1992 | Kahl et al. | 220/324 X |
| 5,135,124 | 8/1992 | Wobser | 220/293 X |
| 5,150,804 | 9/1992 | Blanchet et al. . | |
| 5,165,563 | 11/1992 | McKendry . | |
| 5,253,758 | 10/1993 | Bissell, II | 220/212 X |
| 5,273,182 | 12/1993 | Laybourne | 215/394 X |
| 5,363,963 | 11/1994 | Allen | 220/324 X |
| 5,507,406 | 4/1996 | Urciuloi et al. | 220/789 X |
| 5,511,680 | 4/1996 | Kinne | 220/791 X |
| 5,570,797 | 11/1996 | Yeh | 215/392 X |
| 5,586,656 | 12/1996 | Abrums | 220/212 X |
| 5,638,976 | 6/1997 | Arnold | 220/293 X |
| 5,641,065 | 6/1997 | Owens et al. | 220/324 X |
| 5,695,086 | 12/1997 | Viola | 215/319 X |
| 5,799,792 | 9/1998 | Abrums | 220/212 X |

FIG. 9
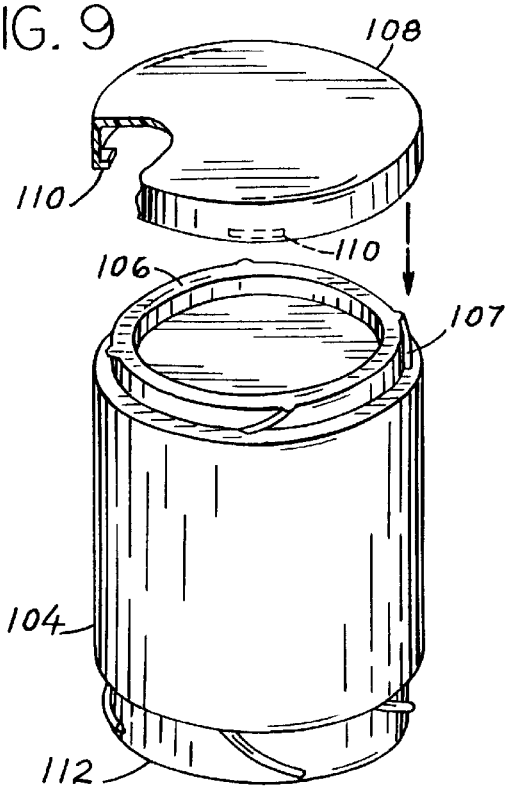
FIG. 7
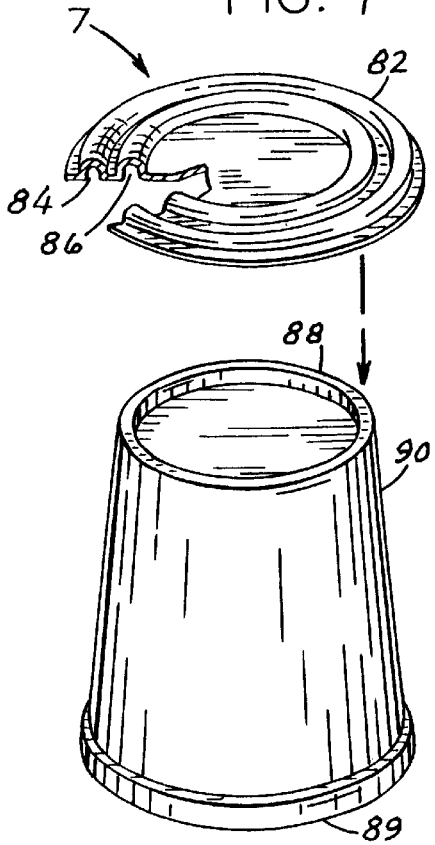
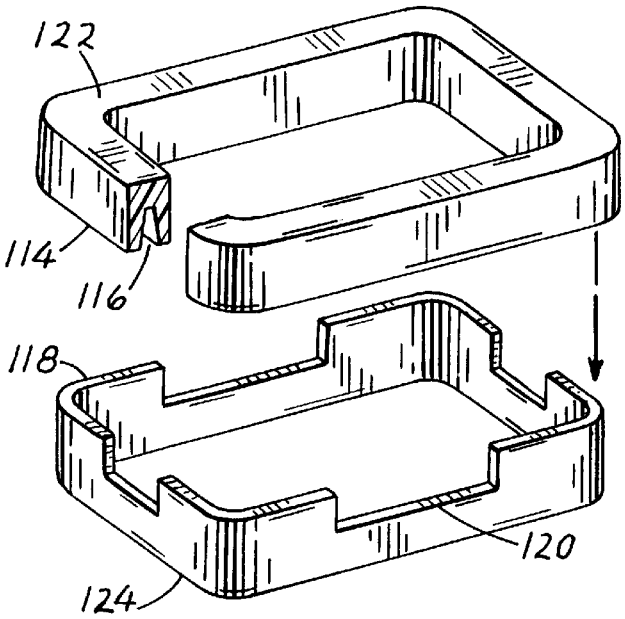
FIG. 10
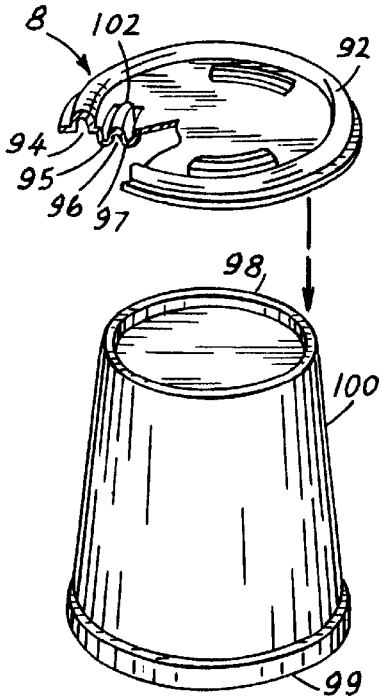
FIG. 8

STORAGE CONTAINER WITH SELF-RETAINING LID

CROSS-REFERENCES TO RELATED APPLICATIONS

This is a continuation-in-part application of Ser. No. 08/803,272 filed on Feb. 20, 1997, now U.S. Pat. No. 5,868,268.

BACKGROUND OF THE INVENTION

1. Field of the Invention

The present invention relates generally to storage containers and more specifically to a storage container with a self-retaining lid which allows attachment to a storage container without sealing thereof.

2. Discussion of the Prior Art

Storage containers, specifically food storage containers have no structure for attaching a lid without sealing the container. This would not be a problem accept that a food storage container must be cleaned after use. After cleaning, lids are stored separately from containers, because there can be a problem with bacterial growth, or odors inside a moist sealed storage container. The simple solution to the bacterial growth and odor problems is to keep the lid and storage container separate. This simple solution will be satisfactory if the user has few storage containers, or all are the same size. If the user has many food storage containers of different sizes, the lids soon become mismatched or lost when stored separately. The user also has a problem with a compartment filled with numerous lids and containers; time is wasted trying to match the correct lid with the correct storage container.

The concept of attaching a lid to the bottom or top of a storage container is not limited to food storage containers, but can be applied to any substance which is sealed in any type of storage container, such as a glass jar, or a styrofoam cup.

Accordingly, there is a clearly felt need in the art for a self-retaining lid which may be attached to the top or bottom of a storage container without sealing thereof.

SUMMARY OF THE INVENTION

The primary objective of the present invention is to provide a self-retaining lid which may be attached to the top or bottom of a storage container with out sealing thereof.

According to the present invention, a storage container with self-retaining lid includes a lid and a storage container. The structure for attaching the lid can be molded on to the bottom of the storage container, molded on to the top of the lid, or molded to the lid and the bottom of the storage container. There are several preferred embodiments of the storage container with self-retaining lid.

In a first preferred embodiment, the lid has a rim with a recessed cavity molded on the side opposite the sealing cavity for firmly receiving a sealing lip of a storage container. The rim is interrupted with a plurality of air openings to allow moisture to escape the inside of the storage container.

In a second preferred embodiment, the bottom of the storage container has a lip which is sized to be firmly inserted into the a recessed cavity which is molded into the lid. The lip is interrupted with a plurality of air openings to allow moisture to escape from the lid.

In a third preferred embodiment, the bottom of the storage container has a plurality of balls which are disposed to mate with a plurality of sockets on the lid. The sockets can also be mounted on the bottom of the storage container and the balls on the lid.

In a fourth preferred embodiment, a plurality of hooks are molded into at least two sides of the container and sized to receive the peripheral edge of the lid.

In a fifth preferred embodiment, the bottom of the storage container has a plurality of corner lips which are sized to be firmly inserted into the sealing cavity of the lid.

In a sixth preferred embodiment, the lid has a plurality of blocks with recessed cavities for firmly receiving a sealing lip of the storage container. The blocks are molded on the side opposite the sealing cavity.

The structure for attaching a self-retaining lid to a styrofoam cup can be molded into surface of the self-retaining lid. A self-retaining lid may have a recessed cavity to accommodate attachment to the bottom lip of a styrofoam cup.

The structure for attaching a lid to a glass jar may be formed at the bottom of the glass jar. A lip with a plurality of thread projections are molded on to the bottom of the glass jar. The lid is screwed on to the lip similar to how the lid is screwed on to the top of the glass jar.

A lid and storage container may have a two position sealing structure which has the features of a self retaining lid without having to attach the self retaining lid to a bottom of the storage container. The two position sealing structure utilizes at least one projection which is formed around the inside perimeter of the storage container. First and second channels are formed on the outside perimeter of the lid. At least one vent opening is formed between the first and second channels. The storage container is sealed when the at least one projection is mated to the second channel. Moisture may escape through the at least one vent opening when the at least one projection is engaged in the second channel.

Accordingly, it is an object of the present invention to provide a self-retaining lid which may be fastened to the top of a storage container without sealing thereof.

It is a further object of the present invention to provide a a storage container that is structured to retain a lid on the bottom thereof.

It is yet a further object of the present invention to provide a self-retaining lid which may only be fastened to the respective storage container and not to a similarly sized storage container.

It is yet a further of the present invention to provide a storage container which is structured to firmly receive a self-retaining lid at the bottom of the storage container.

Finally, it is another object to provide a storage container and lid with a two position sealing structure which allows the container to be sealed in a first position and to allow air to enter the container in a second position.

These and additional objects, advantages, features and benefits of the present invention will become apparent from the following specification.

BRIEF DESCRIPTION OF THE DRAWINGS

FIG. 7 is a perspective view of a styrofoam cup with a first preferred embodiment of a self-retaining lid in accordance with the present invention.

FIG. 8 is a perspective view of a styrofoam cup with a second preferred embodiment of a self-retaining lid in accordance with the present invention.

FIG. 9 is a perspective view of a glass jar with a lip molded as part of a bottom to retain a lid in accordance with the present invention.

FIG. 10 is a perspective view of a rim structure and lip structure which may be fastened to an existing storage container and lid in accordance with the present invention.

DETAILED DESCRIPTION OF THE PREFERRED EMBODIMENTS

Figure 1:
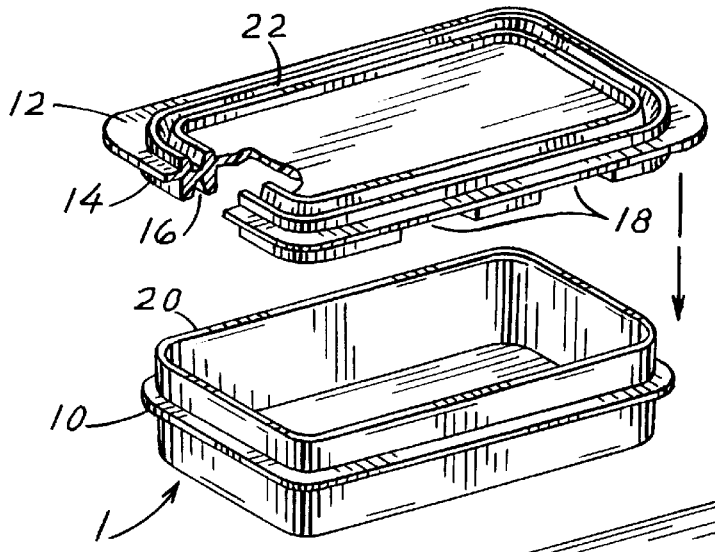
FIG. 1 is a perspective view of a first preferred embodiment of a storage container with a self-retaining lid in accordance with the present invention.

With reference now to the drawings, and particularly to FIG. 1, there is shown a perspective view of a first preferred embodiment of a storage container with self-retaining lid 1. The storage container with self-retaining lid 1 includes a storage container 10 and a self-retaining lid 12. A cutaway has been made in the self-retaining lid 12 to show a rim 14 with a recessed cavity 16. The recessed cavity 16 firmly receives a sealing lip 20 of the storage container 10. The rim 14 is molded on the side opposite the sealing cavity 22. The continuity of the rim 14 is interrupted by a plurality of air openings 18 which allow moisture contained in the storage container to escape. The sealing cavity 22 mates with the sealing lip 20 to seal the storage container 10. It is also possible to make a separate structure which contains the rim 14 with the recessed cavity 16. The structure would be fastened with double backed tape, glue, or other suitable fastening means to a lid of an existing storage container.

Figure 2:
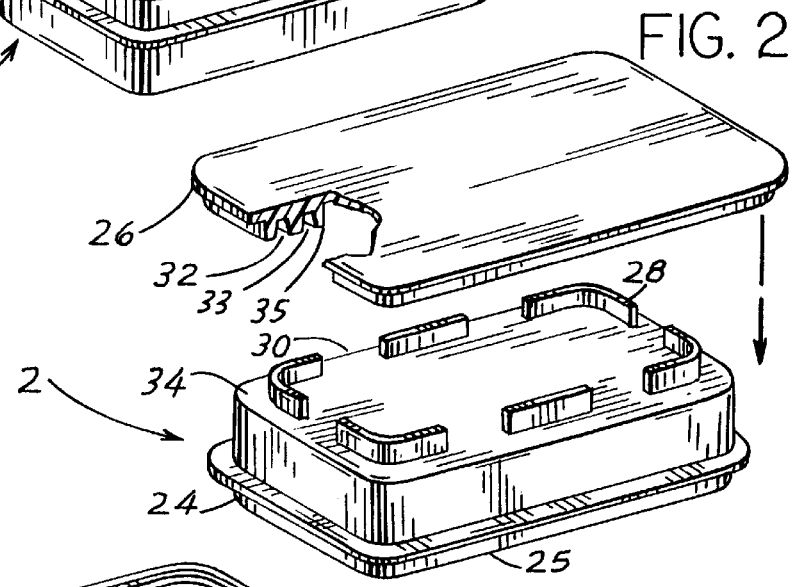
FIG. 2 is a perspective view of a second preferred embodiment of a storage container with a self-retaining lid in accordance with the present invention.

FIG. 2 shows a perspective view of a second preferred embodiment of a storage container with a self-retaining lid 2. The storage container with self-retaining lid 2 includes a storage container 24 and a lid 26. A cutaway has been made in the lid 26 to show a sealing cavity 32, a projection 35, and a recessed cavity 33. The projection 35 and the recessed cavity 33, need not be continuous as the sealing cavity 32, but may take the form of a plurality of projections and recessed cavities to accommodate only the solid portions of the lip 28. A lip 28 is disposed on the bottom 34 of the storage container 24.

The continuity of the lip 28 is interrupted by a plurality of air openings 30 which allow moisture contained in the storage container 24, or on the lid 26 to escape. The storage container 24 has a sealing lip 25 which is disposed on the end opposite the bottom 34. The sealing cavity 32 mates with the sealing lip 25 to seal the storage container 24. It is also possible to make a separate structure which contains the lip 28 with the plurality of air openings 30. The structure would be fastened with double backed tape, glue, or other suitable fastening means to the bottom of an existing storage container.

Figure 3A:
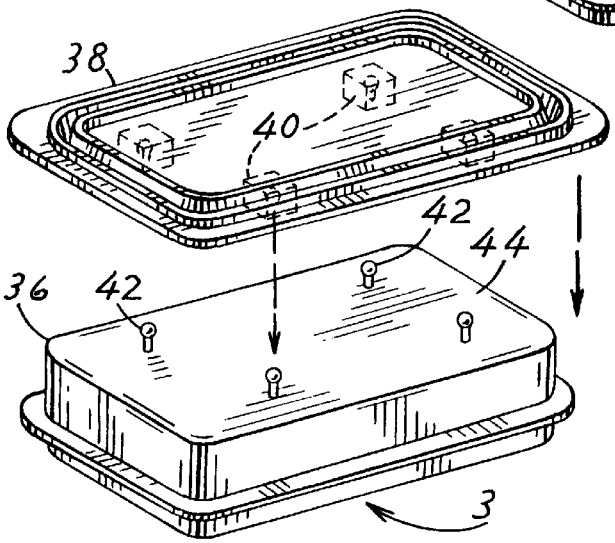
FIG. 3A is a perspective view of a third preferred embodiment of a storage container with a self-retaining lid in accordance with the present invention.

FIG. 3*a* shows a perspective view of a third preferred embodiment of a storage container with a self-retaining lid 3. The storage container with self-retaining lid 3 includes a storage container 36 and a lid 38. A plurality of balls 42 are molded on to a bottom 44 of the storage container 36. A plurality of mating sockets 40 are molded on to either side of the lid 38. The location of the plurality of balls 42 and the plurality of mating sockets 40 are such that only the correct size lid 38 may be attached to the bottom 44, not a lid from a larger or smaller container.

Figure 3B:
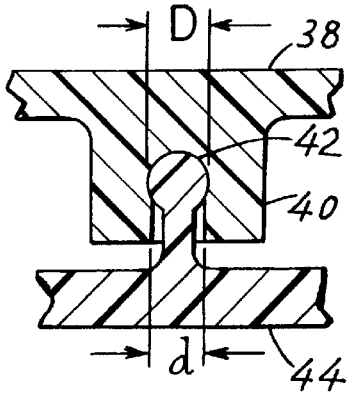
FIG. 3B is a cross-sectional view of a ball and socket connector in accordance with the present invention.

FIG. 3*b* shows a ball 42 inserted into a mating socket 40. The entrance diameter "d"of the socket 40 is slightly smaller than the end diameter "D"of the socket 40 to retain the ball 42. It is also possible to make two separate structures, one would contain a plurality of balls 42 and the other a plurality of sockets 40. Each structure could be fastened with double backed tape, glue, or other suitable fastening means to the bottom of an existing storage container or lid.

Figure 4:
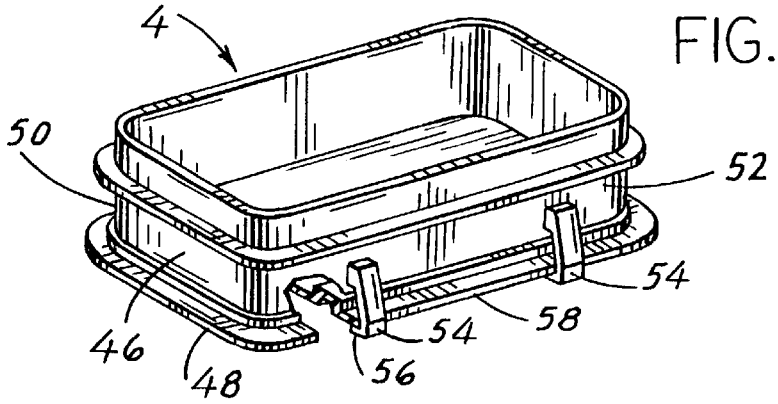
FIG. 4 is a perspective view of a fourth preferred embodiment of a storage container with a self-retaining lid in accordance with the present invention.

FIG. 4 shows a perspective view of a fourth preferred embodiment of a storage container with a self-retaining lid 4. The storage container with self-retaining lid 4 includes a storage container 46 and a lid 48. The storage container 46 has a first side 50 and a second side 52. At least one hook 54 is molded into the first side 50 and the second side 52. A ledge 56 of the hook 54 retains the peripheral edge 58 of the lid 48. The lid 48 can be snapped into the plurality of hooks 54. At least one hook 54 may also be molded into a third side and a fourth side of the storage container 46. It is also possible to make a separate structure which contains at least one hook 54. The structure could be fastened with double backed tape, glue, or other suitable fastening means to the side of an existing storage container.

Figure 5:
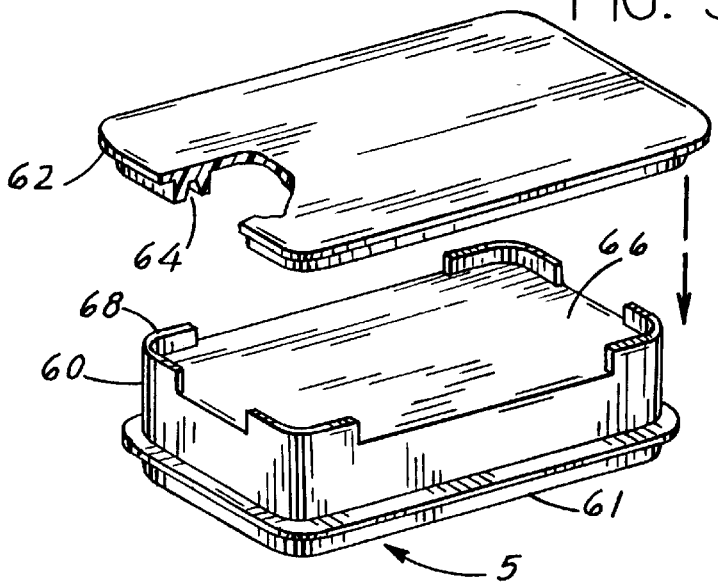
FIG. 5 is a perspective view of a fifth preferred embodiment of a storage container with a self-retaining lid in accordance with the present invention.

FIG. 5 shows a perspective view of a fifth preferred embodiment of a storage container with self-retaining lid 5. The storage container with self-retaining lid 5 includes a storage container 60 and a lid 62. A cutaway has been made in the lid 62 to show a sealing cavity 64. A corner lip 68 is molded into a bottom 66 of the storage container 60. A corner lip 68 is disposed at each of the four corners of the bottom 66. The sealing cavity 64 mates with the plurality of corner lips such that the lid 62 is retained by the storage container 60. The storage container 60 has a sealing lip 61 which is disposed at the end opposite the bottom 66. The sealing cavity 64 mates with the sealing lip 61 to seal the storage container 60. It is also possible to make a separate structure which contains the plurality of corner lips 68. The structure would be fastened with double backed tape, glue, or other suitable fastening means to the bottom of an existing storage container.

Figure 6:
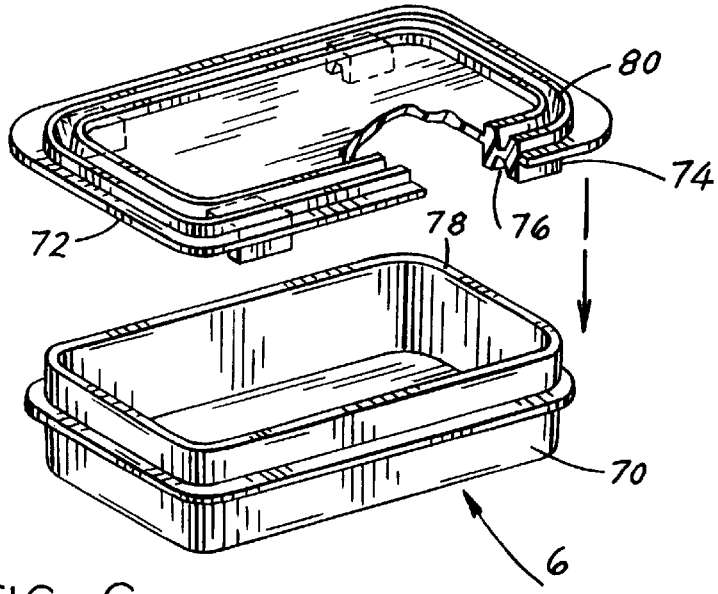
FIG. 6 is a perspective view of a sixth preferred embodiment of a storage container with a self-retaining lid in accordance with the present invention.

FIG. 6 shows a perspective view of a sixth preferred embodiment of a storage container with self-retaining lid 6. The storage container with self-retaining lid 6 includes a storage container 70 and a self-retaining lid 72. A cutaway has been made in the self-retaining lid 72 to show a block 74 with a recessed cavity 76. The recessed cavity 76 firmly receives a sealing lip 78 of the storage container 70. A plurality of blocks 74 are molded on the side opposite the sealing cavity 80. The sealing cavity 80 mates with the sealing lip 78 to seal the storage container 70. It is also possible to make a separate structure which contains the plurality of blocks 74 with the recessed cavity 76. The structure would be fastened with double backed tape, glue, or other suitable fastening means to a lid of an existing storage container.

FIG. 7 shows a perspective view of a styrofoam cup with a first preferred embodiment of a self-retaining lid 7. The styrofoam cup with a first preferred embodiment of a self-retaining lid 7 includes a styrofoam cup 90 and a self-retaining lid 82. A cutaway has been made in the self-retaining lid 82 to show the recessed cavity 86. The recessed cavity 86 is molded into the self-retaining lid 82 concentric to a sealing cavity 84. The recessed cavity 86 is sized to be retained by a lip 88 which is molded on the bottom of the styrofoam cup 90. A sealing lip 89 is molded on the end opposite the lip 88. A sealing cavity 84 mates with the sealing lip 89 to seal the styrofoam cup 90.

FIG. 8 shows a perspective view of a styrofoam cup with a second preferred embodiment of a self-retaining lid 8. The styrofoam cup with a second preferred embodiment of a self-retaining lid 8 includes a styrofoam cup 100 and a self-retaining lid 92. A cutaway has been made in the self-retaining lid 92 to show the recessed cavity 96. The recessed cavity 96 is formed from a first molded projection 95 and a second molded projection 97. The first molded projection 95 and the second molded projection 97 do not have to form a continuous diameter, but may be molded as a plurality of retaining projections 102. The recessed cavity 96 is sized to be retained by the lip 98 which is molded on the bottom of the styrofoam cup 100. A sealing lip 99 is molded on the end opposite the lip 98. A sealing cavity 94 mates with the sealing lip 99 to seal the styrofoam cup 100.

FIG. 9 shows a perspective view of a glass jar 104 with a lip 106 molded as part of a bottom to retain a lid 108. The lip 106 has a plurality of thread projections 107 which are molded into the side of thereof. The plurality of threads projections 107 are similar those at the top 112 of the glass jar 104. A cutaway shows the lid 108 with a tab 110 which sized to engage with the plurality of thread projections 107. The number of thread projections 107 corresponds to the number of tabs 110 in the lid 108.

A glass jar having a lid with a single continuous thread may have a rim molded on the bottom with a single thread to retain thereof. It is also possible to make a separate structure which contains the lip 106 with the plurality of thread projections 107. The structure could be fastened with double backed tape, glue, or other suitable fastening means to the bottom of an existing glass jar.

Figure 11:
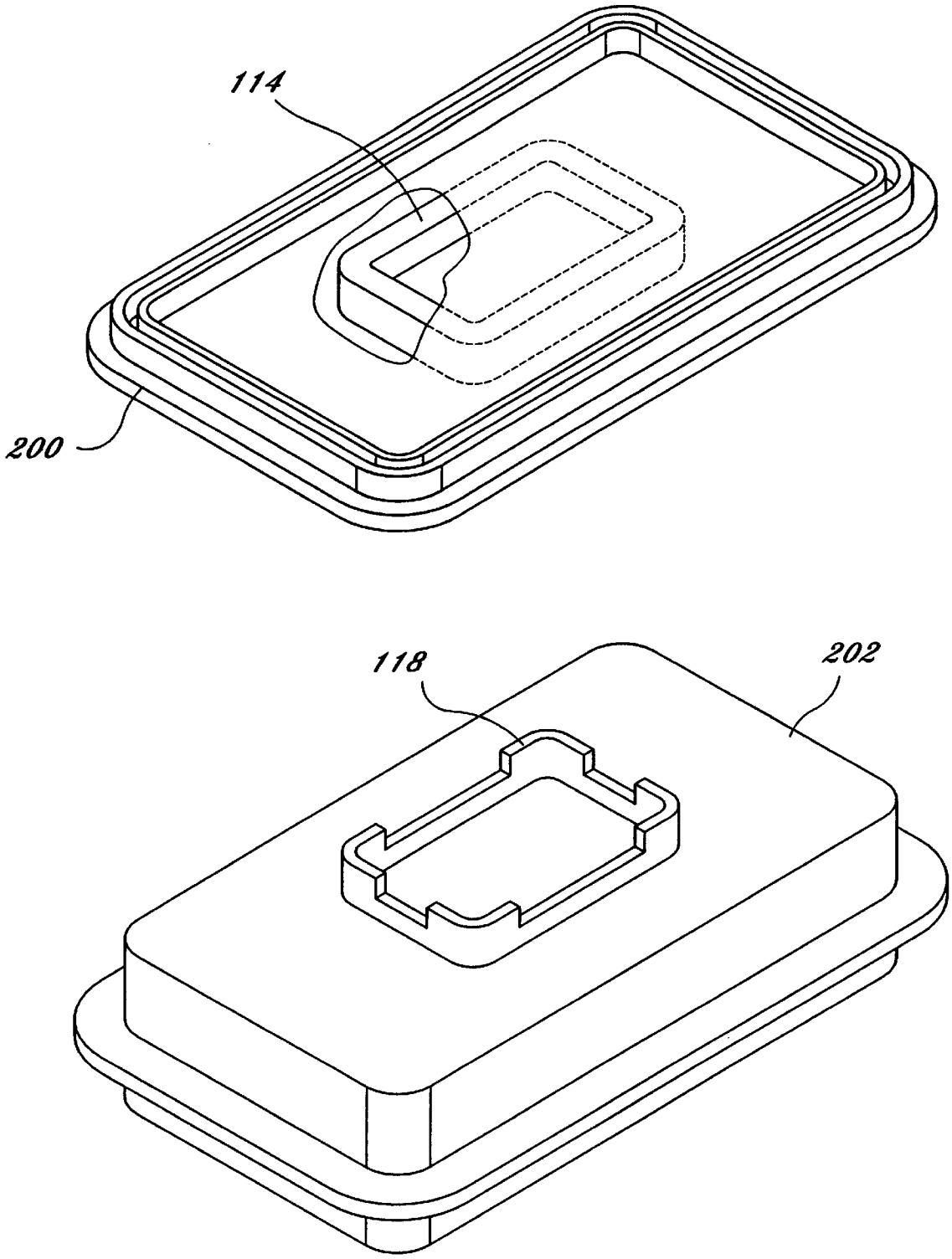
FIG. 11 is a perspective view of a rim structure and lip structure attached to a prior art storage container and lid in accordance with the present invention.

FIG. 10 shows a perspective view of a rim structure 114 and a lip structure 118 which may be fastened to a prior art container and lid. A cutaway of the rim structure 114 reveals a recessed cavity 116 which is sized to firmly receive the lip structure 118. The lip structure 118 has a plurality of air openings 120. With reference to FIG. 11, a bottom surface 122 of the rim structure 114 is fastened to either a prior art lid 200 or a storage 202 with double backed tape, glue, or other suitable fastening means. A bottom surface 124 of the lip structure 118 is fastened to either the prior art storage container 202 or the lid 200 with double backed tape, glue, or other suitable fastening means. The shape of the rim structure 114 and lip structure 118 may be square, rectangular, round, oval or the shape of any existing storage container. The size of the rim structure 114 and lip structure 118 can also be made to match the size of any size prior art storage container 202.

Figure 12:
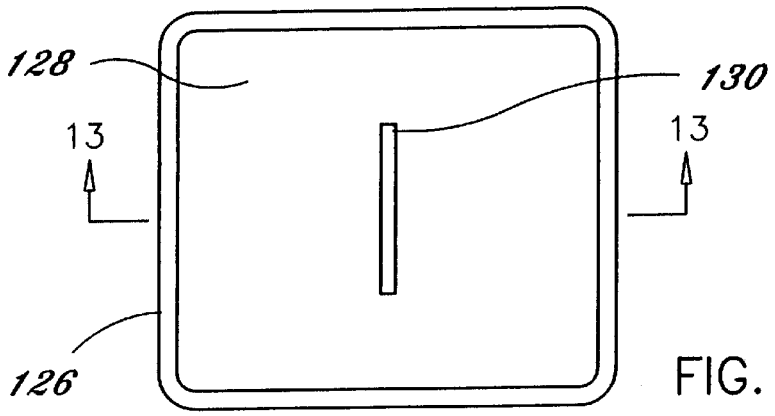
FIG. 12 is a top view of a storage container and lid with a two position double sealing structure in accordance with the present invention.
Figure 13:
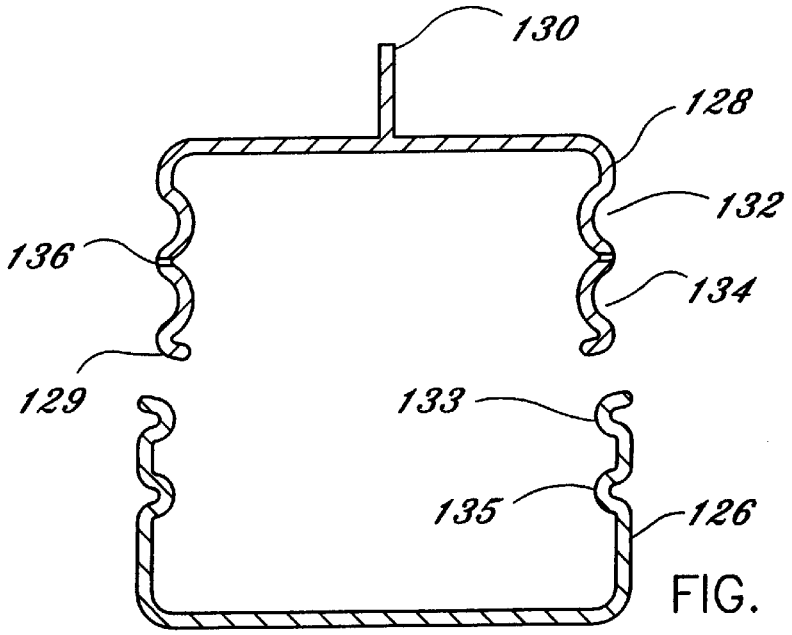
FIG. 13 is a cross-sectional view of a storage container and lid with a two position double sealing structure in accordance with the present invention.

FIGS. 12 and 13 show a lid 128 and storage container 126 with a two position double sealing structure. A first channel 132 and a second channel 134 are formed around the outside perimeter of the lid 128 at substantially a bottom thereof. A first projection 133 and a second projection 135 mate with the first and second channels which are formed on the inside perimeter of the storage container 126 at substantially a top thereof. An in-turned edge 129 is formed on a bottom perimeter of the lid 128 to facilitate insertion into the storage container 126. The first and second projections could also be formed in the lid 128 with the in-turned edge 129, the first channel 132, and the second channel 134 formed on the storage container 126.

Figure 14A:
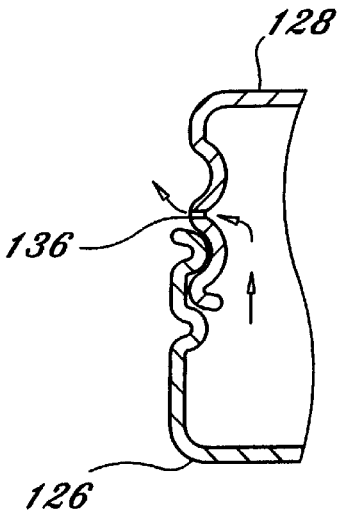
FIG. 14*a* is a partial cross-sectional view of a storage container and lid with a two position double sealing structure in a first position in accordance with the present invention.
Figure 14B:
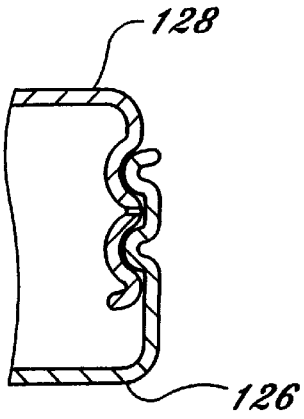
FIG. 14*b* is a partial cross-sectional view of a storage container and lid with a two position double sealing structure in a second position in accordance with the present invention.

At least one vent opening 136 is formed between the first and second channels. A lifting tab 130 is preferably formed on a top of the lid 126. Other lifting means for removing the lid 128 from the storage container 126 may also be used. FIG. 14*a* shows the first projection 133 fitting into the second channel 134 in a first position. Moisture may escape from the storage container 126 through the at least one vent opening 136 in the first position. FIG. 14*b* shows the first and second projections fitting into the first and second channels in a second position to seal the lid 128 to the storage container 126.

Figure 15:
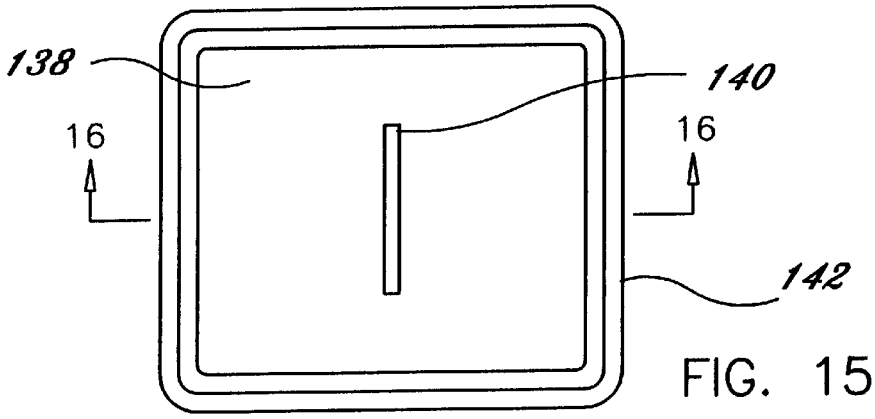
FIG. 15 is a top view of a storage container and lid with a two position sealing structure in accordance with the present invention.
Figure 16:
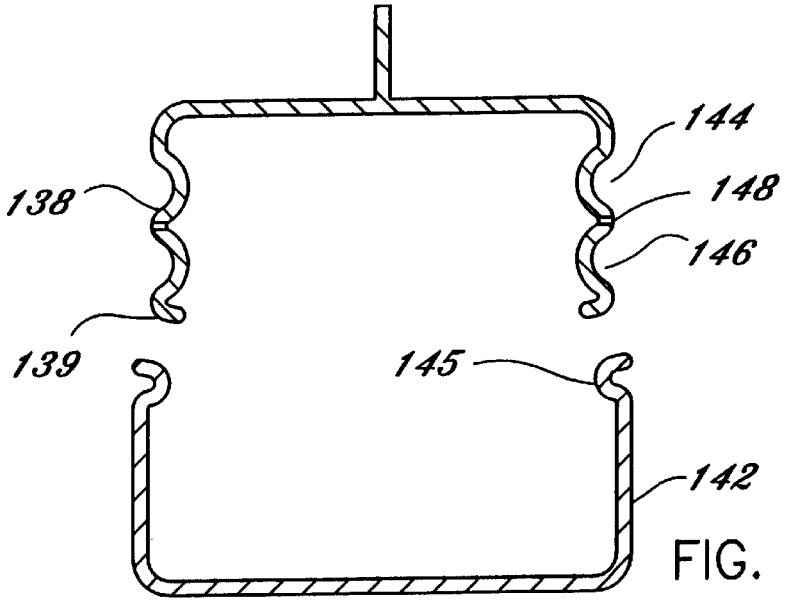
FIG. 16 is a cross-sectional view of a storage container and lid with a two position sealing structure in accordance with the present invention.

FIGS. 15 and 16 show a lid 138 and storage container 142 with a two position sealing structure. A first channel 144 and a second channel 146 are formed around an outside perimeter of the lid 138 at substantially a bottom thereof. A projection 145 is formed on the inside perimeter at substantially a top thereof and mates with the first and second channels. At least one vent opening 148 is formed between the first and second channels. A lifting tab 140 is preferably formed on a top of the lid 138. Other lifting means for removing the lid 138 from the storage container 142 may also be used. An in-turned edge 139 is formed on a bottom perimeter of the lid 138 to facilitate insertion into the storage container 142. The projection 145 could also be formed on the lid 138 with the in-turned edge 139 the first channel 144, and the second channel 146 formed on the storage container 142.

Figure 17A:
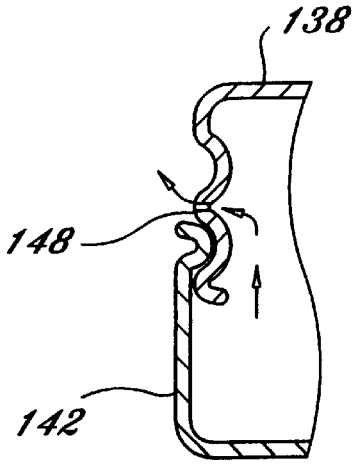
FIG. 17*a* is a partial cross-sectional view of a storage container and lid with a two position sealing structure in a first position in accordance with the present invention.
Figure 17B:
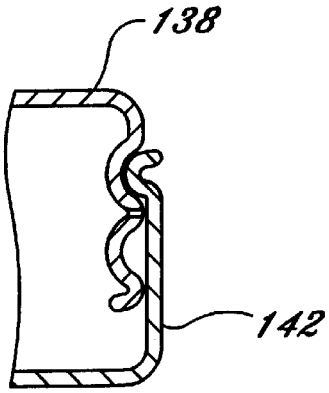
FIG. 17*b* is a partial cross-sectional view of a storage container and lid with a two position sealing structure in a second position in accordance with the present invention.

FIG. 17*a* shows the projection 145 fitting into the second channel 146 in a first position. Moisture may escape from the storage container 142 through the at least one vent opening 148 in the first position. FIG. 17*b* shows the projection 145 fitting into the first channel 144 in a second position to seal the lid 138 to the storage container 142.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A storage container with a lid comprising:

a storage container having a bottom, a top, a first side, a second side, said first side being opposite said second side;

a sealing lip terminating a top of said storage container;

a sealing cavity being formed in said lid, said sealing cavity being sized to firmly receive said sealing lip, said lid having a peripheral edge; and at least one first hook being disposed on said first side, at least one second hook being disposed on said second side, said first hook having a first ledge, said second hook having a second ledge, said peripheral edge of said lid being retained by said at least one first ledge and said at least one second ledge in a non-sealed storage position on a bottom of said storage container.

2. The storage container with a lid of claim 1, further comprising:

at least one said hook being molded into a third side of said storage container; and at least one said hook being molded into a fourth side of said storage container.

3. A storage container with a self-retaining lid comprising:

a storage container having a bottom, a sealing lip, and at least two balls extending from said bottom, said sealing lip being disposed on a side opposite said bottom; and a self-retaining lid having a plurality of mating sockets and a sealing cavity, said sealing cavity being disposed on the side opposite said plurality of mating sockets on said self-retaining lid, said sealing cavity mating with said sealing lip to seal said storage container, at least two sockets mating with said at least two balls to store said self-retaining lid on said bottom of said container in a non-sealed, storage position, said self-retaining lid being firmly retained by the mating of said at least two sockets and said at least two balls.

4. A storage container and lid having a two position sealing structure comprising:

a lid having a first channel and a second channel formed in a perimeter thereof, at least one vent opening being disposed between said first and second channels, an in-turned edge being formed on a bottom perimeter of said lid; and a storage container having a first projection formed in a perimeter thereof, said first projection mating with said second channel in a first position to allow moisture to escape said storage container, said first projection mating with said first channel in a second position to seal said container from air intrusion.

5. The storage container and lid having a two position sealing structure of claim 4, further comprising:

a second projection being formed below said first projection, said first projection mating with said first channel and said second projection mating with said second channel when said lid is in said second position.

6. The storage container and lid having a two position sealing structure of claim 4, further comprising:

said lid having a lifting means for removing said lid from said storage container.

* * * * *